US010190425B2

(12) United States Patent
Drake et al.

(10) Patent No.: US 10,190,425 B2
(45) Date of Patent: Jan. 29, 2019

(54) FLOW SPLITTING FIRST VANE SUPPORT FOR GAS TURBINE ENGINE

(71) Applicant: UNITED TECHNOLOGIES CORPORATION, Farmington, CT (US)

(72) Inventors: Christopher Drake, Atlanta, GA (US); Christopher B Lyons, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 297 days.

(21) Appl. No.: 14/916,291

(22) PCT Filed: Sep. 3, 2014

(86) PCT No.: PCT/US2014/053809

§ 371 (c)(1),
(2) Date: Mar. 3, 2016

(87) PCT Pub. No.: WO2015/038374

PCT Pub. Date: Mar. 19, 2015

(65) Prior Publication Data

US 2016/0215633 A1 Jul. 28, 2016

Related U.S. Application Data

(60) Provisional application No. 61/875,807, filed on Sep. 10, 2013.

(51) Int. Cl.
*F01D 9/06* (2006.01)
*F01D 9/04* (2006.01)
(Continued)

(52) U.S. Cl.
CPC ..... *F01D 9/041* (2013.01); *F01D 5/187* (2013.01); *F01D 9/065* (2013.01); *F01D 11/005* (2013.01);
(Continued)

(58) Field of Classification Search
CPC ..... F01D 9/041; F01D 5/187; F01D 25/12; F01D 11/005; F01D 25/246; F01D 9/065;
(Continued)

(56) References Cited

U.S. PATENT DOCUMENTS 4,173,120 A 11/1979 Grosjean et al.
4,213,738 A 7/1980 Williams
(Continued)

FOREIGN PATENT DOCUMENTS

EP 0628728 A1 * 12/1994 ..... F23R 3/04

OTHER PUBLICATIONS

The Extended European Search Report for EP Application No. 14844169.4, dated Jun. 16, 2017.
(Continued)

*Primary Examiner* — Eldon Brockman
(74) *Attorney, Agent, or Firm* — Carlson, Gaskey & Olds, P.C.

(57) ABSTRACT

A gas turbine engine includes an engine static structure that has a fluid port. A turbine vane is supported relative to the engine static structure and includes a cooling passage. A flow splitter is provided between the engine static structure and the turbine vane. The flow splitter is configured to divide a flow upstream from the flow splitter into a first fluid flow provided to the fluid port and a second fluid flow provided to the cooling passage.

12 Claims, 3 Drawing Sheets

(51) Int. Cl.

| | |
|---|---|
| ***F01D 25/24*** | (2006.01) |
| ***F01D 5/18*** | (2006.01) |
| ***F01D 11/00*** | (2006.01) |
| ***F01D 25/12*** | (2006.01) |
| ***F23R 3/04*** | (2006.01) |

(52) U.S. Cl.
CPC ..... *F01D 25/12* (2013.01); *F01D 25/246* (2013.01); *F23R 3/04* (2013.01); *F05D 2220/32* (2013.01); *F05D 2240/35* (2013.01)

(58) Field of Classification Search
CPC ..... F01D 9/023; F23R 3/04; F05D 2240/35; F05D 2220/32
See application file for complete search history.

(56) References Cited

U.S. PATENT DOCUMENTS

| | | | | |
|---|---|---|---|---|
| 4,657,482 | A | 4/1987 | Neal | |
| 4,785,623 | A | 11/1988 | Reynolds | |
| 4,821,522 | A | 4/1989 | Matthews et al. | |
| 5,020,318 | A * | 6/1991 | Vdoviak | F01D 9/065 60/226.1 |
| 5,077,967 | A * | 1/1992 | Widener | F23R 3/04 415/208.1 |
| 5,187,931 | A | 2/1993 | Taylor | |
| 5,252,026 | A | 10/1993 | Shepherd | |
| 5,289,677 | A | 3/1994 | Jarrell | |
| 5,335,501 | A * | 8/1994 | Taylor | F23R 3/04 60/747 |
| 5,407,319 | A | 4/1995 | Harrogate et al. | |
| 8,388,307 | B2 | 3/2013 | Smoke et al. | |
| 8,727,703 | B2 * | 5/2014 | Laurello | F01D 5/081 415/115 |
| 2007/0068165 | A1 * | 3/2007 | Tiemann | F01D 25/12 60/751 |
| 2007/0116562 | A1 | 5/2007 | West et al. | |
| 2010/0275612 | A1 | 11/2010 | Smoke et al. | |
| 2012/0057967 | A1 * | 3/2012 | Laurello | F01D 5/081 415/178 |

OTHER PUBLICATIONS

International Search Report and Written Opinion for PCT Application No. PCT/US2014/053809, dated Feb. 16, 2015.
International Preliminary Report on Patentability for PCT Application No. PCT/US2014/053809 dated Mar. 24, 2016.

* cited by examiner

FLOW SPLITTING FIRST VANE SUPPORT FOR GAS TURBINE ENGINE

CROSS-REFERENCE TO RELATED APPLICATIONS

This application claims priority to U.S. Provisional Application No. 61/875,807, which was filed on Sep. 10, 2013.

STATEMENT REGARDING FEDERALLY SPONSORED RESEARCH OR DEVELOPMENT

This invention was made with government support under Contract No. FA8650-09-D-29230021 awarded by the United States Air Force. The Government has certain rights in this invention.

BACKGROUND

This disclosure relates to a downstream portion of a diffuser used to provide diffuser flow to various components of a gas turbine engine, for example, for cooling.

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Historically, a fan in the fan section was driven at the same speed as a turbine within the turbine section. More recently, it has been proposed to include a gear reduction between the fan section and a fan drive turbine. With this change, the diameter of the fan has increased dramatically and a bypass ratio or volume of air delivered into the bypass duct compared to a volume delivered into the compressor has increased. With this increase in bypass ratio, it becomes more important to efficiently utilize the air that is delivered into the compressor section. Military engines also benefit from effective use of compressed air.

One factor that increases the efficiency of the use of this air is to have a higher pressure at the exit of a high pressure compressor. This high pressure results in a high temperature increase. The temperature at the exit of the high pressure compressor is known as $T_3$ in the art. T3 air may be used to supply fluid to a diffuser case surrounding a combustor housing in the combustor section to diffuse the compressed air entering the combustor housing. Super-cooled fluid from a heat exchanger may also be used, or used as an alternative to T3 air, to provide a diffuser flow around the combustor housing.

It may be desirable to use diffuser flow for other purposes. Pulling air from large bosses on the diffuser case, over the combustor or first vane, leads to local pressure drops. These pressure drops can greatly affect the dilution effectiveness (pattern factor) of the diffuser flow and vane cooling which both can lead to durability issues for the turbine section due to local hot spots.

SUMMARY

In one exemplary embodiment, a gas turbine engine includes an engine static structure that has a fluid port. A turbine vane is supported relative to the engine static structure and includes a cooling passage. A flow splitter is provided between the engine static structure and the turbine vane. The flow splitter is configured to divide a flow upstream from the flow splitter into a first fluid flow provided to the fluid port and a second fluid flow provided to the cooling passage.

In a further embodiment of the above, the engine static structure supports a diffuser case that is arranged about a combustor housing to provide a diffuser plenum. The upstream flow corresponds to a diffuser flow in the diffuser plenum.

In a further embodiment of any of the above, a component is in fluid communication with the fluid port. The component is configured to receive the first fluid flow.

In a further embodiment of any of the above, the flow splitter is provided by an annular ring that is arranged radially between the engine static structure and the turbine vane to provide first and second radially spaced cavities.

In a further embodiment of any of the above, the annular ring includes an aft wall that seals against an aft platform flange of the turbine vane.

In a further embodiment of any of the above, the engine static structure includes a diffuser case and a turbine case that are secured to one another. The annular ring includes an aft wall that is captured between the diffuser case and the turbine case.

In a further embodiment of any of the above, a locating feature between the flow splitter and the engine static structure is configured to circumferentially affix the flow splitter to the engine static structure.

In a further embodiment of any of the above, the engine static structure includes one of a fork and a tab. The flow splitter includes the other of the fork and the tab. The tab is received in the fork and comprises the locating feature.

In a further embodiment of any of the above, a locating feature between the flow splitter and the turbine vane is configured to circumferentially affix the turbine vane to the flow splitter.

In a further embodiment of any of the above, the flow splitter includes one of a fork and a tab. The turbine vane includes the other of the fork and the tab. The tab is received in the fork and comprises the locating feature.

In a further embodiment of any of the above, a ring seal engages the other of the fork and the tab of the turbine vane.

In a further embodiment of any of the above, a turbine section includes a first stage array of turbine stator vanes which include the turbine vane.

In a further embodiment of any of the above, a diffuser case and a combustor case are affixed relative to the engine static structure and arranged upstream from the turbine vane.

In a further embodiment of any of the above, a tangential on-board injector is secured to the turbine vane and is configured to provide a TOBI flow to a turbine rotor arranged downstream from the turbine vane.

In another exemplary embodiment, a flow splitter for a gas turbine engine includes an annular ring which includes an axially extending wall that provides inner and outer diameters. The axially extending wall protrudes from an intermediate portion of a radially extending wall. One of a tab and a fork extend radially outward from the outer diameter. Another of a tab and a fork extend radially inward from the inner diameter.

In a further embodiment of the above, the one of the tab and the fork is a tab.

In a further embodiment of any of the above, the other of the tab and the fork is a tab.

In another exemplary embodiment, a method of flowing fluid through a gas turbine engine, includes providing a diffuser flow and splitting the diffuser flow into first and second fluid flows. The second fluid flow is provided to a turbine vane airfoil.

In a further embodiment of the above, the first fluid flow is provided to a component through a bleed port in an engine static structure. The splitting step is performed by providing a flow splitter that is arranged radially between the engine static structure and the turbine vane.

In a further embodiment of any of the above, the flow splitter includes an annular ring which includes an axially extending wall that provides inner and outer diameters. The axially extending wall protrudes from an intermediate portion of a radially extending wall. One of a tab and a fork extend radially outward from the outer diameter. Another of a tab and a fork extend radially inward from the inner diameter.

BRIEF DESCRIPTION OF THE DRAWINGS

The disclosure can be further understood by reference to the following detailed description when considered in connection with the accompanying drawings wherein.

DETAILED DESCRIPTION

Figure 1:
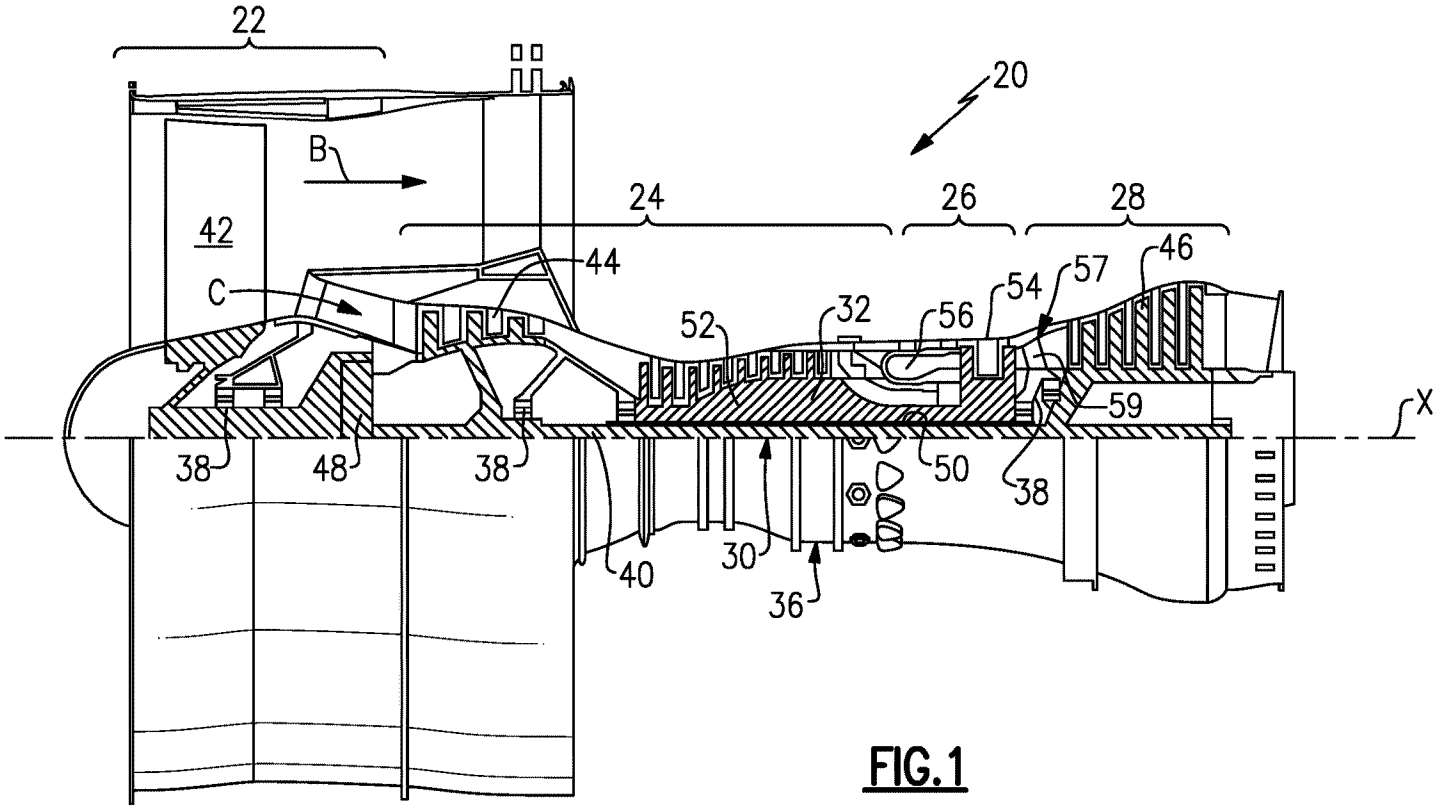
FIG. 1 is a schematic view of an example gas turbine engine including a combustor section.

FIG. 1 schematically illustrates a gas turbine engine 20. Although commercial engine embodiment is shown, the disclosed cooling feature may also be used in military engine applications. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features.

Figure 2:
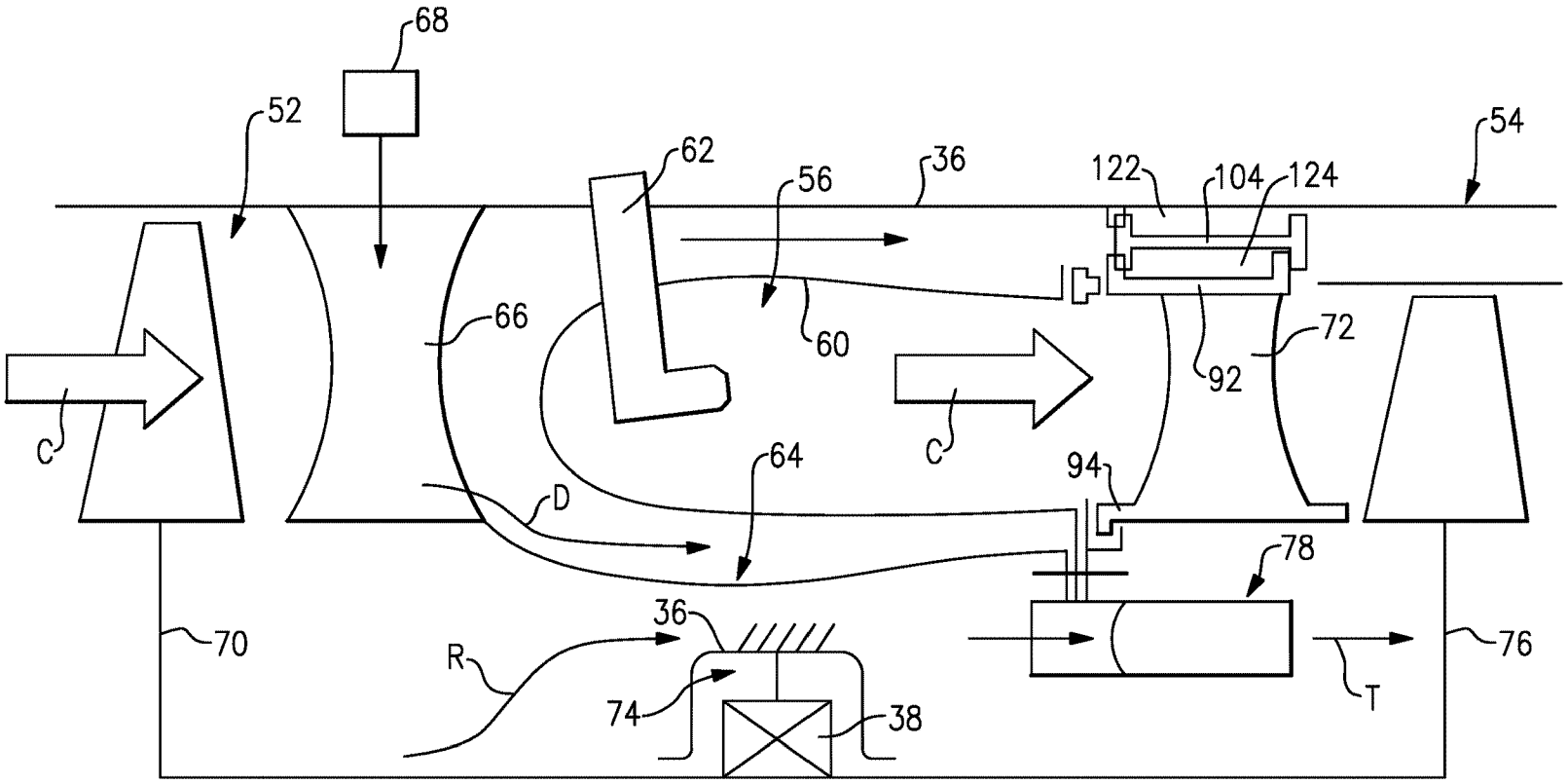
FIG. 2 is a schematic view of a combustor section arranged fluidly between a compressor section and a turbine section.

The fan section 22 drives air along a bypass flowpath B while the compressor section 24 drives air along a core flowpath C (as shown in FIG. 2) for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 supports one or more bearing systems 38 in the turbine section 28. The inner shaft 40 and the outer shaft 50 are concentric and rotate via bearing systems 38 about the engine central longitudinal axis A, which is collinear with their longitudinal axes.

The core airflow C is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

An area of the combustor section 26 is shown in more detail in FIG. 2. The combustor section 26 includes a combustor 56 having a combustor housing 60. An injector 62 is arranged at a forward end of the combustor housing 60 and is configured to provide fuel to the combustor housing 60 where it is ignited to produce hot gases that expand through the turbine section 54.

A diffuser case 64 is secured to the combustor housing 60 and forms a diffuser plenum surrounding the combustor housing 60. The diffuser plenum may receive a diffuser flow D for diffusing flow from the compressor section 52 into the combustor section 56. The diffuser case 64 and the combustor housing 60 are fixed relative to the engine static structure 36. In one example, a circumferential array of vanes 72 of a first stage of turbine stator vanes includes an inner portion that is partially supported by the diffuser case 64.

With continuing reference to FIG. 2, the diffuser case 64 includes a portion arranged downstream from the compressor section 52 and upstream from the combustor section 26 that is sometimes referred to as a "pre-diffuser" 66. A bleed source 68, such as fluid from a compressor stage, provides cooling fluid through the pre-diffuser 66 to various locations interiorly of the diffuser case 64. A heat exchanger (not shown) may be used to cool the cooling fluid before entering the pre-diffuser 66.

The compressor section 52 includes a compressor rotor 70 supported for rotation relative to the engine static structure 36 by the bearing 38. The bearing 38 is arranged within a bearing compartment 74 that is buffered using a buffer flow R. The turbine section 54 includes a turbine rotor 76 arranged downstream from a tangential on-board injector module 78, or "TOBI." The TOBI 78 provides cooling flow T to the turbine rotor 76.

Figure 3:
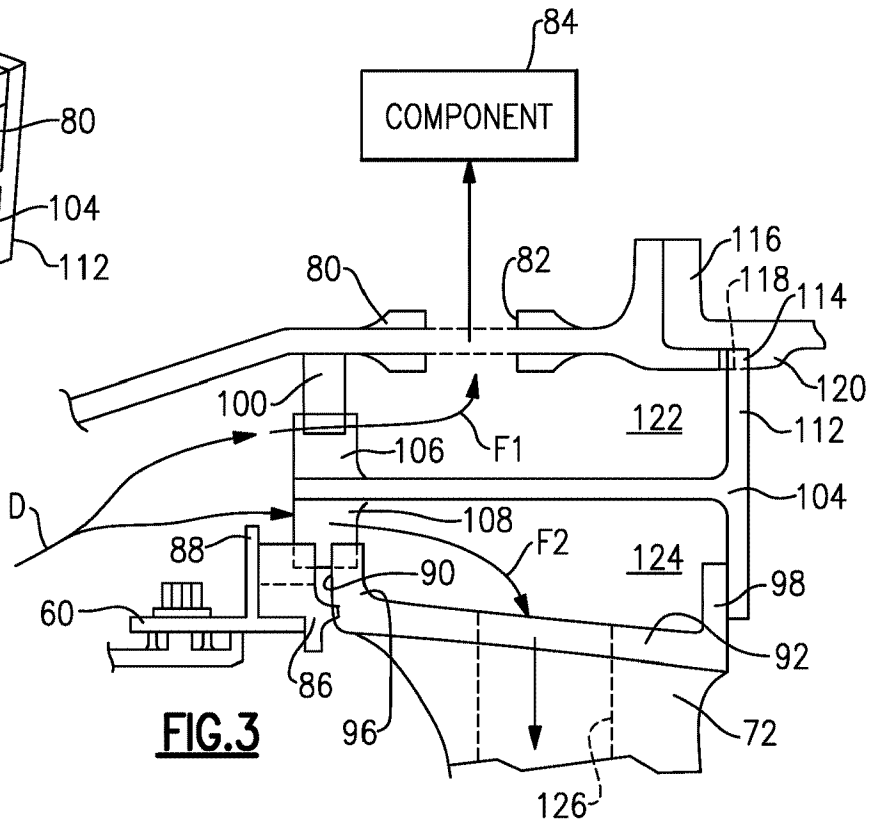
FIG. 3 is an enlarged cross-sectional view of a first stage array of stator vanes and a combustor housing.

Referring to FIG. 3, the engine static structure 36 includes an outer diffuser case 80. In one example, the outer diffuser case 80 includes a bleed port 82 for supplying a first fluid flow F1 to a component 84 for cooling the component.

A ring seal 86 is provided between an annular protrusion 88 provided on the combustor housing 60 and a forward face 90 of the vane 72 to seal the core flow C from the diffuser flow D. The vane 72 includes radially spaced apart outer and inner platforms 92, 94 joined to one another by one or more airfoils, which include a cooling passage 126. Axially spaced apart forward and aft platform flanges 96, 98 extend radially outward from the outer platform 92. The forward platform flange 96 provides the forward face 90 against which the ring seal 86 seals.

A flow splitter 104 is arranged radially between the outer diffuser case 80 and the outer platform 92 to separate the diffuser flow D into the first fluid flow F1 and a second fluid flow F2, as shown in FIG. 3. In one example, the splitter 104 is a full hoop or annular ring.

Figure 4:
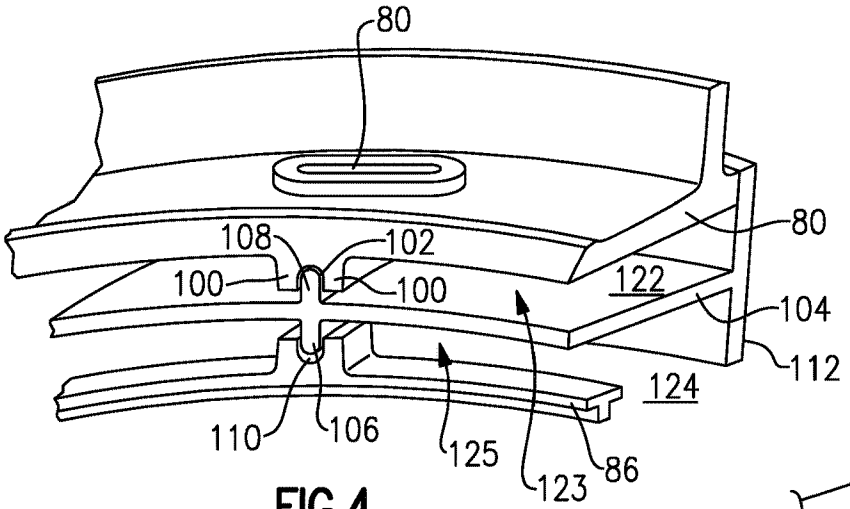
FIG. 4 is a partial perspective view of a diffuser case and a flow splitter shown in FIG. 3.
Figure 5:
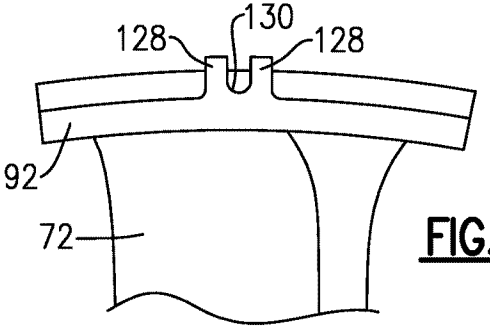
FIG. 5 is a partial schematic view of an outer diameter platform of the vane.

Locating features are provided between the flow splitter 104 and the engine static structure 36 and the vane 72. The flow splitter 104 includes radial extending inner and outer tabs 106, 108 that are respectively received in the notches 102, 130. Referring to FIG. 4, the outer diffuser case 80 includes circumferentially spaced forks 100 that each provides a notch 102. As shown in FIG. 5, each vane 72 includes spaced apart forks 128 on the outer platform 92 that provide a notch 130. The seal ring 86 may also include an axially extending groove 110 that receives a portion of the inner tab 106. Tabs and forks may be provided on components other than shown and still provide the desired locating features.

The flow splitter 104 includes an axially extending wall joined to an aft wall 112 that extends radially inward and outward from the axially extending wall. The aft wall 112 is axially opposite the tabs 106, 108, which are respectively provided on inner and outer diameters of the axially extending wall, to provide radially spaced apart first and second annular cavities 122, 124. The diffuser flow D enters each of the first and second annular cavities 122, 124 through openings 123, 125, as shown in FIG. 4. The openings 123, 125 can be sized to control the split of fluid into the cavities or other flow regulating approaches may be used.

The aft wall 112 includes an outer edge 114 that is arranged between the outer diffuser case 80 and a turbine case 116. Complimentary teeth 118 may be provided on the outer edge 114 and turbine case 116 to circumferentially retain the flow splitter 104 relative to the engine static structure 36, which, in turn, circumferentially locates the seal ring 86 and vane 72. A shoulder 120 is provided in the turbine case 116 to axially locate the outer edge 114 relative to the engine static structure.

The flow splitter 104 provides a vane support, which is used in clocking the vanes 72 and reacting out combustor and vane loads to the engine static structure 36. With this design, the fork clocking features are utilized on the ring seal 86 and on the outer diffuser case 80. The vane 72 is also sandwiched between the outer diffuser case 80 and the turbine case 116 with teeth 118 which lock it in its circumferential location. As the engine runs, air passes through the combustor section 56 and is split so that a portion of the diffuser flow D goes to the component 84 and another portion of the diffuser flow D goes into the vane 72 for cooling.

This design maximizes the space above the vane 72 by splitting the flow into a bleed area, the first cavity 122, and a vane cooling area, the second cavity 124. This design also allows for the designer to better control how much flow is sent to each area by changing the flow area into these sections. The disclosed design minimizes the local pressure drops due to bleed air and allows for an improved pattern factor and a more even vane cooling.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A gas turbine engine comprising:

an engine static structure having a fluid port;

a turbine vane supported relative to the engine static structure and including a cooling passage;

a flow splitter provided between the engine static structure and the turbine vane, the flow splitter configured to divide a flow upstream from the flow splitter into a first fluid flow provided to the fluid port and a second fluid flow provided to the cooling passage; and a locating feature between the flow splitter and the engine static structure configured to circumferentially affix the flow splitter to the engine static structure, wherein the engine static structure includes one of a fork and a tab, and the flow splitter includes the other of the fork and the tab, the tab received in the fork and comprising the locating feature.

2. The gas turbine engine according to claim 1, wherein the engine static structure supports a diffuser case arranged about a combustor housing to provide a diffuser plenum, an upstream flow corresponding to a diffuser flow in the diffuser plenum.

3. The gas turbine engine according to claim 1, comprising a component in fluid communication with the fluid port, the component configured to receive the first fluid flow.

4. The gas turbine engine according to claim 1, wherein the flow splitter is provided by an annular ring arranged radially between the engine static structure and the turbine vane to provide first and second radially spaced cavities.

5. The gas turbine engine according to claim 4, wherein the annular ring includes an aft wall that seals against an aft platform flange of the turbine vane.

6. The gas turbine engine according to claim 4, wherein engine static structure includes a diffuser case and a turbine case secured to one another, and the annular ring includes an aft wall captured between the diffuser case and the turbine case.

7. The gas turbine engine according to claim 1, comprising a turbine section including a first stage array of turbine stator vanes which include the turbine vane.

8. The gas turbine engine according to claim 7, comprising a diffuser case and a combustor case affixed relative to the engine static structure and arranged upstream from the turbine vane.

9. The gas turbine engine according to claim 7, comprising a tangential on-board injector secured to the turbine vane and configured to provide a TOBI flow to a turbine rotor arranged downstream from the turbine vane.

10. A gas turbine engine comprising:

an engine static structure having a fluid port;

a turbine vane supported relative to the engine static structure and including a cooling passage;

a flow splitter provided between the engine static structure and the turbine vane, the flow splitter configured to divide a flow upstream from the flow splitter into a first fluid flow provided to the fluid port and a second fluid flow provided to the cooling passage; and a locating feature between the flow splitter and the turbine vane configured to circumferentially affix the turbine vane to the flow splitter, wherein the flow splitter includes one of a fork and a tab, and the turbine vane includes the other of the fork and the tab, the tab received in the fork and comprising the locating feature.

11. The gas turbine engine according to claim 10, comprising a ring seal engaging the other of the fork and the tab of the turbine vane.

12. A method of flowing fluid through a gas turbine engine, comprising:

providing a diffuser flow; and splitting the diffuser flow into first and second fluid flows, wherein the second fluid flow is provided to a turbine vane airfoil, wherein the first fluid flow is provided to a component through a bleed port in an engine static structure, the splitting step performed by providing a flow splitter arranged radially between the engine static structure and the turbine vane, wherein the flow splitter includes an annular ring having an axially extending wall providing inner and outer diameters, the axially extending wall protruding from an intermediate portion of a radially extending wall, and one of a tab and a fork extending radially outward from the outer diameter, and another of a tab and a fork extending radially inward from the inner diameter.

* * * * *